United States Patent [19]

Kephart

[11] 4,260,078

[45] Apr. 7, 1981

[54] BOTTLE ATTACHMENT HAVING OUTLET AND VENT

[76] Inventor: Ryan K. Kephart, P.O. Box 706, Murphy, N.C. 28906

[21] Appl. No.: 67,131

[22] Filed: Aug. 16, 1979

[51] Int. Cl.[3] ..... B67D 3/00; B67D 5/64

[52] U.S. Cl. ..... 222/184; 222/185; 222/325; 222/484

[58] Field of Search ..... 220/69; 222/131, 184, 222/185, 165, 325, 483, 484, 485, 478, 183

[56] References Cited

U.S. PATENT DOCUMENTS

| | | | |
|---|---|---|---|
| 1,125,450 | 1/1915 | Bonnell | 222/185 X |
| 1,202,804 | 10/1916 | Chadwick | 222/325 UX |
| 1,260,333 | 3/1918 | Cordley | 222/131 |
| 3,139,219 | 6/1964 | Grau | 222/131 X |
| 3,685,694 | 8/1972 | Ianelli | 222/325 X |

*Primary Examiner*—David A. Scherbel

[57] ABSTRACT

This invention relates to drink dispensers and particularly to an attachment for a bottle whereby the bottle and the attachment may be placed in an inverted position on a shelf and the contents dispensed as needed. The attachment comprises a tubular member having the same contour as the bottle but slightly larger and adapted to fit over the bottle and to form a base for the bottle when the bottle and attachment are inverted. A partition within the attachment contains a closure for the bottle, so that the closure will take the place of the original cap. The attachment closure has two flexible tubes extending through it. One, the dispensing tube, terminates just inside the closure, and the other, the vent tube, is long enough to extend into the bottle to a point near the bottom thereof. Both tubes lead through an opening in the attachment. Both tubes are provided at their outer ends with a manually operable control device or faucet which normally maintains both tubes closed, but will permit the tubes to be opened manually. When the bottle with the attachment applied is inverted, for example, on the shelf of a refrigerator, the liquid therein is free to flow through the dispensing tube toward the control device or faucet. The control device or faucet may be mounted on the outside of the tubular member, or the tubes may be extended sufficiently to permit moving the control device or faucet to a glass or cup a short distance from the bottle without moving the bottle.

6 Claims, 4 Drawing Figures

BOTTLE ATTACHMENT HAVING OUTLET AND VENT

Many drinks are now being sold in large plastic bottles of two liter size. If one or two glasses of the contents are poured from such a bottle only occasionally, and the bottle is left for a period of time, the contents may lose some of its flavor. Also such bottles are fairly heavy and may be hard to handle by children or weaker persons.

It is one of the objects of the invention to provide an inexpensive attachment for such a bottle which will permit glasses to be filled without touching the bottle at all and without losing any of the flavor even if left for a considerable time between uses.

Another object of the invention is to provide an attachment for a bottle which may be placed onto the bottle in place of the cap and which will act as a base for the bottle when it is inverted and placed on a shelf, the attachment being provided with a manually controllable device or faucet to permit the contents of the bottle to be dispensed, as desired, without touching the bottle and still maintaining the bottle sealed when not in use.

Still another object of the invention is to provide an attachment for a screw-capped bottle which can be attached to the bottle in place of the cap and which includes a dispensing tube and a vent which are normally secured closed at their outer ends and which may be manually opened simultaneously to permit the fluid in the bottle to flow out of the bottle and air to enter the bottle to displace the fluid which is removed.

Other objects of the invention will be apparent as the description of the invention proceeds.

One embodiment of the invention is illustrated in the accompanying drawings in which.

Figure 1:
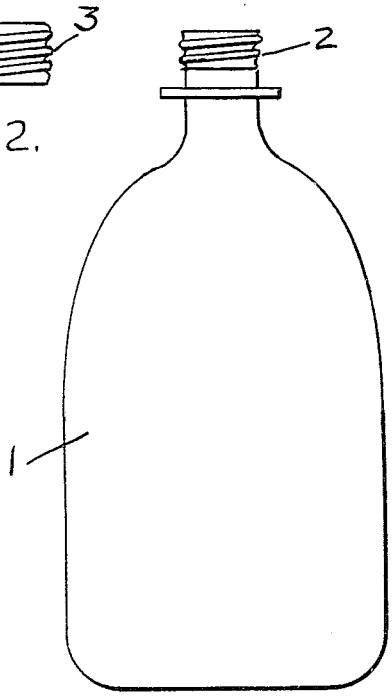
FIG. 1 is an elevational view of a bottle which is to provide with a threaded neck to receive a screw cap.
Figure 2:
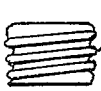
FIG. 2 shows the screw cap.
Figure 3:
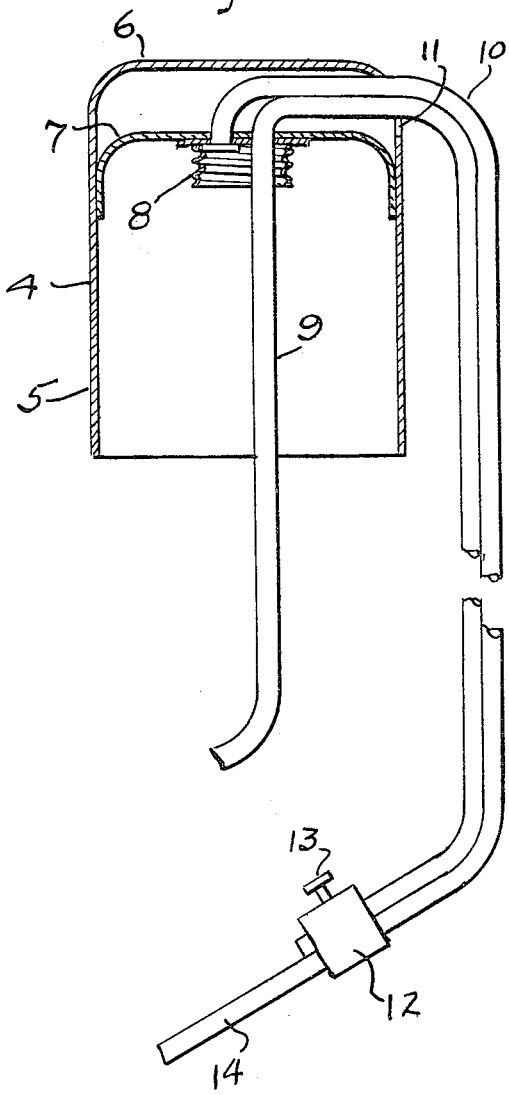
FIG. 3 is a sectional, elevational view of the attachment of the invention, showing it ready to be applied to the bottle when the cap of the bottle is removed.
Figure 4:
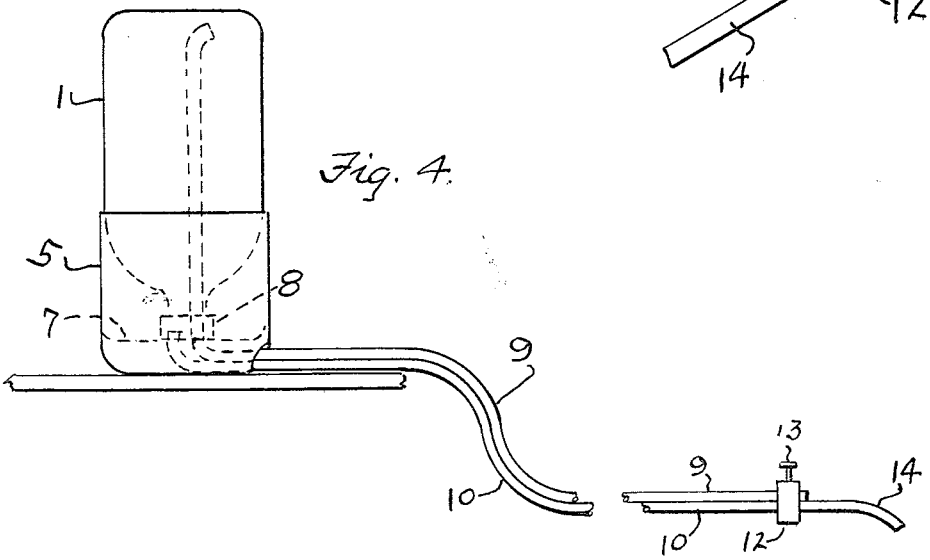
FIG. 4 is an elevational view of the bottle with the attachment applied and ready for use in the inverted position.

Referring now more specifically to the drawings, FIG. 1 shows the bottle 1 with a threaded neck 2 to receive the cap 3 which is shown in FIG. 2. The attachment 4 is shown in cross section in FIG. 3 in the position it would assume before applying to the bottle 1. The attachment comprises a tubular member 5 made of plastic or other desirable material and slightly larger in contour than that of the bottle, so that it can fit snugly over the bottle. It may be of suitable length to fit well over the bottle, as shown. The end 6 of the attachment may be closed as shown, or it may be left open, if desired, the only requirement being that it be of sufficient strength to act as a base for the bottle when the bottle is inverted.

A partition 7 is provided near the upper end of the member 5 which may be of the same material as the member 5 and is cemented or otherwise rigidly secured to it. At the center of the partition 7, I provide a cap 8 which may be similar to the cap 2, so that it can be screwed on to the bottle neck. The cap 8 is cemented or otherwise secured to the partition 7, so as to be an integral part of it.

Two flexible tubes 9 and 10 pass through suitable holes in the cap 8. The tube 9 is a vent tube and is of sufficient length inside the cap to reach near the bottom of the bottle 1 when the attachment 4 is applied to the bottle. The tube 10 is a dispenser tube and its end is sealed just within the cap 8. Both tubes are sealed to the cap 8 to prevent the escape of liquid or air. An opening 11 may be provided in the member 5 between the partition 7 and the outer end 6 of the member through which the tubes 9 and 10 are passed.

The tubes may be of any desired length depending on the manner in which the bottle is to be used. Near the end of the tubes, I provide a manually operable control device or faucet 12 for controlling the opening and closing of the ends of the tubes. Any suitable device for performing this function may be used. For example, the device 12 may contain a spring (not shown) which will normally press against the tubes to maintain them closed and a knob or lever 13 which may be depressed manually to act against the spring to permit the tubes to open. The end 14 of the tube 10 is preferably extended beyond the device 12 so that it may be inserted in a glass to direct the dispensed liquid into the glass.

In using the attachment, the original cap 3 of the bottle 1 is removed and the attachment 4 placed over the bottle with the tube 9 inserted through the neck. The whole attachment is then turned in a clockwise direction to screw the cap 8 inside the attachment to the neck of the bottle. When the attachment is tightly in place, the bottle with the attachment secured thereto may be inverted and placed on the shelf of the refrigerator. The flexible tubes and the control device 12 may then be placed on the shelf out of the way.

When it is desired to obtain a drink from the bottle, the control device 12 may be moved out of the refrigerator without touching the bottle and the end 14 inserted in a glass or pitcher. Then when the knob 13 is depressed, liquid can flow out of the tube 10 to fill the glass or pitcher. At the same time, the vent tube 9 is opened, permitting air to flow into the bottle to occupy the space displaced by the removed liquid.

Although the tubes 9 and 10 have been shown as two separate tubes, they be secured together so as to form one flexible element. Or, if desired, the two tubes may be enclosed in a single tube of larger diameter. Also, although the tubes are shown as being of sufficient length to extend some distance from the bottle, it may be desirable to place the bottle on a table when dispensing the liquid. In such a case, the control device may be attached to the member 5, so that it is rigidly associated with it. The liquid may then be dispensed in the same manner.

If the bottle is not round in cross section, the contour of the attachment should correspond and the cap of the attachment may then be rotatably mounted on the partition, so that it can be rotated independently to screw the cap onto the bottle without rotating the whole attachment. In this case the attachment may be open-ended and provided with a vertical slot to receive the tubes.

Also if the bottle cap is not of the screw type, the cap of the attachment may be such that it will clamp onto the bottle in a well known manner to provide an airtight closure.

In some instances I may terminate the vent tube close to the bottle and provide a one-way valve in the outer end which will permit air to enter the bottle when the pressure of the air inside the bottle decreased as fluid is withdrawn. In this case only the dispensing tube need be long enough to provide convenient dispensing of the fluid.

While one embodiment of the invention has been shown and described, it will be evident that other embodiments might be used without departing from the spirit of the invention, and I do not desire to limit myself to what has been shown and described except by the limitations of the appended claims.

What I desire to claim and secure by Letters Patent is:

1. A dispensing attachment for a bottle comprising a tubular member having the same contour as that of the bottle but slightly larger than the bottle so that it can be slipped over the bottle when the cap is removed, closure means to fit over the opening in the neck of the bottle, means in said tubular member to secure said closure means at a position to fit over the opening in the neck of the bottle when said attachment is placed over said bottle, said tubular member being of sufficient strength to act as a base for said bottle when said bottle and member are inverted, a dispensing tube extending through said closure means and sealed therein, a vent tube extending through said closure means and sealed therein and long enough to extend to a point near the bottom of said bottle when said tubular member is placed over said bottle and said vent tube is inserted therein, said tubular member having an opening in the side thereof between said closure means and the end of said tubular member to permit said tubes to pass therethrough, means normally closing the end of said vent tube, means normally closing the end of said dispensing tube, manually operable means for opening said dispensing tube to permit liquid to flow through said tube from said bottle, and means for opening the end of said vent tube while liquid is flowing through said dispensing tube.

2. A dispensing attachment for a bottle, as defines in claim 1, in which the manually operable dispensing means includes means for normally maintaining the end of both tubes closed and for opening the ends of said tubes simultaneously to permit liquid to flow through said dispensing tube and air to pass through said vent tube into said bottle.

3. A dispensing means for a bottle, as defined in claim 2, in which the dispensing tube and the vent tube are of sufficient length, so that, when the bottle and attachment are inverted and resting on the tubular member as a base, liquid may be dispensed without moving the bottle.

4. A dispensing attachment for a bottle, as defined in claim 3, in which the bottle has a screw cap and the closure means in the tubular member to fit over the opening in the neck of the bottle is also a screw cap, so that the vent tube may be inserted in the bottle and the screw cap in the tubular member rotated to screw said cap onto the bottle.

5. A dispensing attachment for a bottle, as defined in claim 1, in which the bottle has a screw cap and the closure means in the tubular member to fit over the opening in the neck of the bottle is also a screw cap, so that the vent tube may be inserted in the bottle and the closure means may be screwed onto the bottle to close the opening in the neck of the bottle.

6. A dispensing attachment for a bottle, as defined in claim 1, in which the dispensing tube is of sufficient length to reach a convenient distance from the bottle, so that, when the bottle is inverted and resting on the tubular member as a base, liquid may be dispensed without moving the bottle.

* * * * *